United States Patent [19]

Utterback et al.

[11] 4,024,614

[45] May 24, 1977

[54] APPARATUS FOR PRODUCING RESISTORS

[75] Inventors: Jack Olan Utterback, Lindsay, Okla.; John Fajt, Northbrook, Ill.

[73] Assignee: ELT, Incorporated, Northfield, Ill.

[22] Filed: May 30, 1975

[21] Appl. No.: 582,168

[52] U.S. Cl. ..... 29/33 K; 228/4.5; 264/105; 425/123

[51] Int. Cl.[2] ..... B21P 19/04

[58] Field of Search ..... 29/203 S, 619, 621, 29/33 D, 33 K; 264/105; 425/112, 123, 383, 345; 228/4.5

[56] References Cited

UNITED STATES PATENTS

| | | | |
|---|---|---|---|
| 1,991,706 | 2/1935 | Seabury | 425/345 |
| 2,282,328 | 5/1942 | Herrick et al. | 264/105 |
| 2,440,806 | 5/1948 | Megow et al. | 425/123 |
| 3,200,471 | 8/1965 | Johnson et al. | 29/33 K |
| 3,472,443 | 10/1969 | Holzl et al. | 228/4.5 |
| 3,643,321 | 2/1972 | Field et al. | 228/4.5 |

*Primary Examiner*—Leonidas Vlachos
*Attorney, Agent, or Firm*—Dunlap, Codding & McCarthy

[57] ABSTRACT

Apparatus for producing resistors wherein substantially round heads are heat-formed on the ends of the leads and molded, under a predetermined pressure, into electrical and mechanical contact with a quantity of resistive material to form an integral body.

12 Claims, 6 Drawing Figures

APPARATUS FOR PRODUCING RESISTORS

BACKGROUND OF THE INVENTION

1. Field of the Invention

The apparatus of the present invention relates generally to the field of resistor manufacturing, and more particularly, but not by way of limitation, to an apparatus for producing a resistor having the heat-formed, substantially round heads on the ends of the leads thereof, molded, under a constant pressure, into electrical and mechanical contact with the resistive material to form an integral body.

2. Description of the Prior Art

In general, resistors are produced from a pair of leads having enlarged heads on the ends thereof, with the heads being embedded in some manner in a resistive material. Usually, the enlarged heads are either formed separately and attached to the lead in an appropriate manner, or are formed from the lead material itself by such means as swagging. Such methods, however, are often mechanically complicated and may incorporate mechanical weaknesses, such as along the attachment joint or the seams of the swagged head.

In the past, attempts have been made to produce resistors wherein the heads of the leads are molded, under a substantially predetermined pressure, into electrical and mechanical contact with the resistive material. The goal of such apparatus is to produce resistors having predictable resistance rather than a standard length. While generally acceptable, the mechanical pressure compensation means of the prior art apparatus, such as that disclosed in U.S. Pat. No. 2,261,916 issued to G. E. Megow et al on Nov. 4, 1941, are subject to substantial variations in performance.

SUMMARY OF THE INVENTION

The present invention contemplates an apparatus for producing a resistor from a pair of leads and a quantity of resistive material. The apparatus includes a heating means for melting one end of each of the pair of leads to form an enlarged, substantially round head thereon. The apparatus further includes fluid pressure compensated compression means for applying a predetermined pressure to the resistive material to force the heads of the leads into electrical and mechanical contact with the resistive material, thereby forming an integral resistive body which may be cured to obtain a resistor.

An object of the invention is to provide an apparatus for producing resistors in a more efficient and economical manner.

Another object of the invention is to provide an apparatus for economically producing resistor leads having enlarged heads integral therewith which are substantially as strong as the lead itself.

One other object of the invention is to provide an improved apparatus for applying a predetermined pressure to the resistive material to force the leads into electrical and mechanical contact with the resistive material to form an integral resistive body.

Other objects, features and advantages of the present invention will be apparent to those skilled in the art from the following detailed description of the preferred embodiments of the invention when taken in conjunction with the accompanying drawings.

DESCRIPTION OF THE PREFERRED EMBODIMENT

Figure 1:
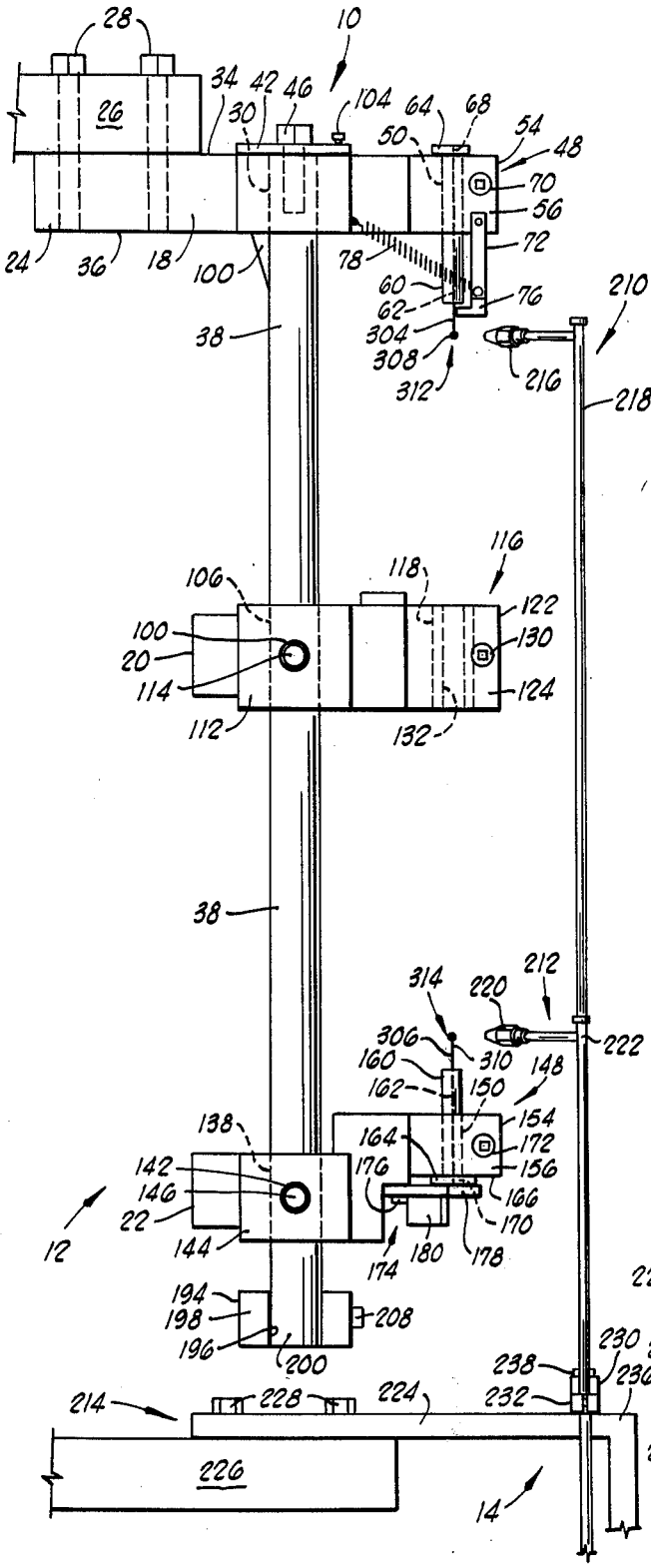
FIG. 1 is a side elevational view of the operating unit and the burner unit of the present invention.
Figure 2:
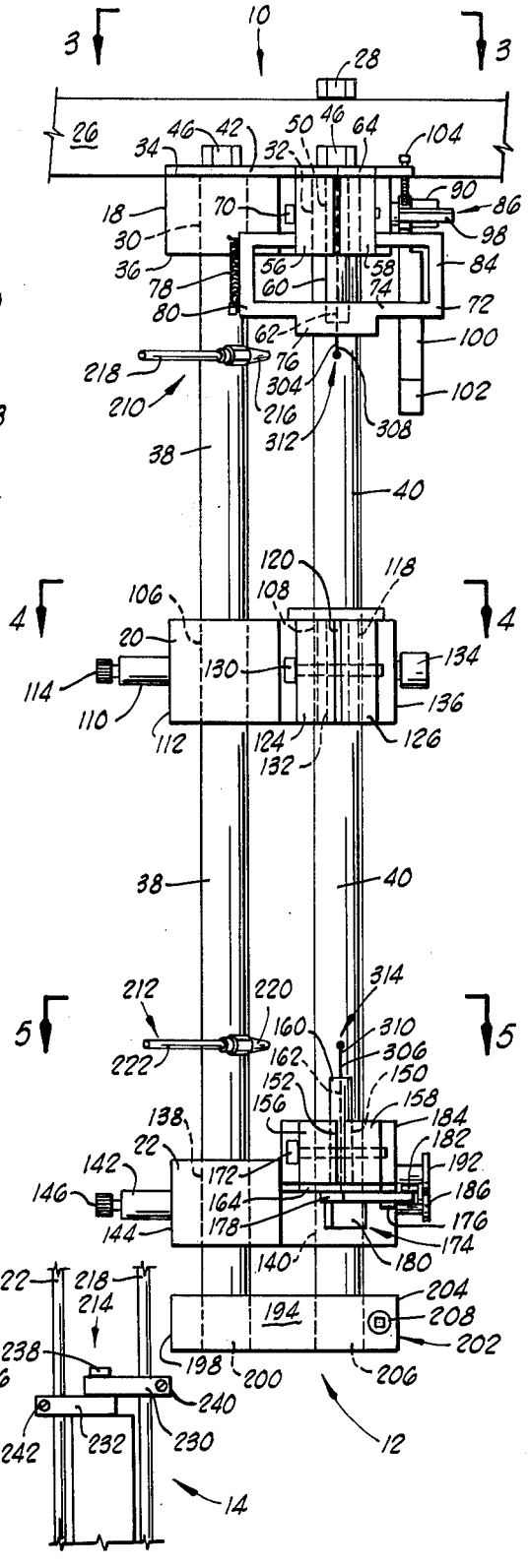
FIG. 2 is a front elevational view of the operating unit and the burner unit of the present invention.
Figure 6:
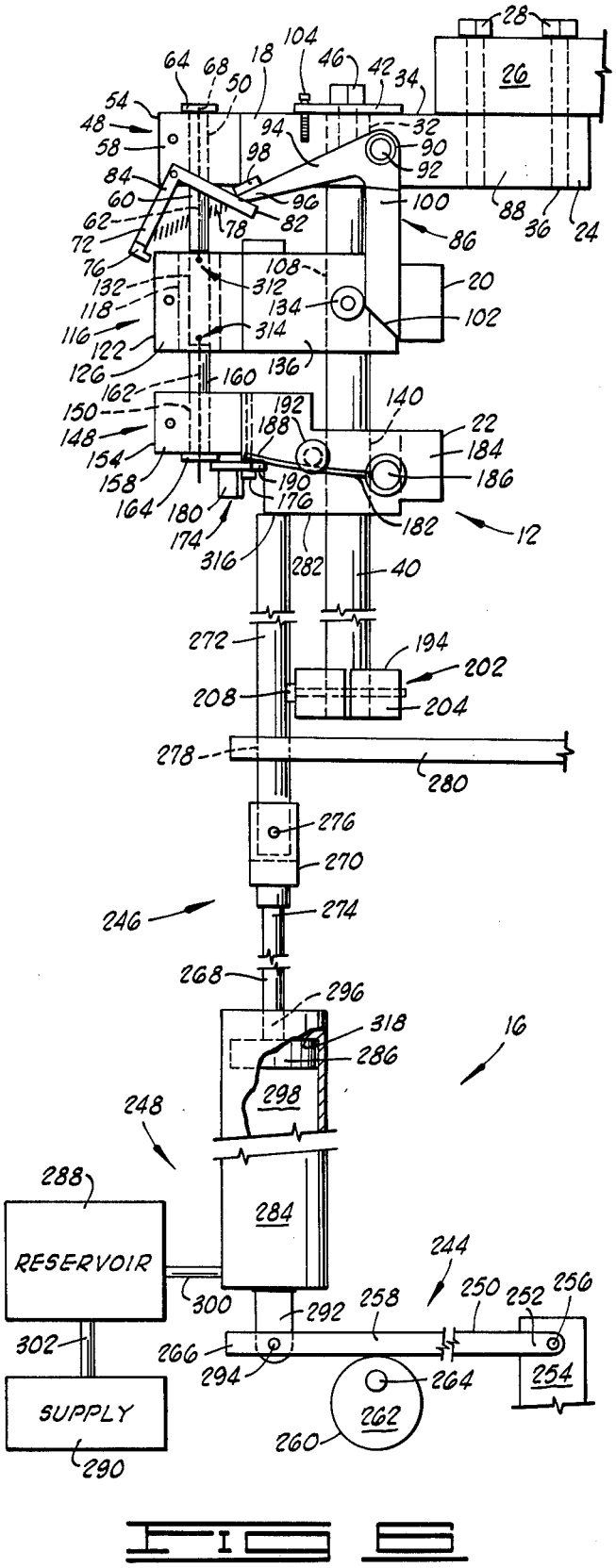
FIG. 6 is a side elevational view of the operating unit and the compression unit of the present invention.

Referring to the figures in general and to FIGS. 1 and 2 in particular, shown therein and designated by the general reference numeral 10 is a resistor making apparatus constructed in accordance with the present invention. The preferred embodiment is comprised of an operating unit 12 which is operated upon by a plurality of functional units of which the heating unit 14 is shown in FIGS. 1 and 2, and the compression unit 16 is shown in FIG. 6.

Figure 3:
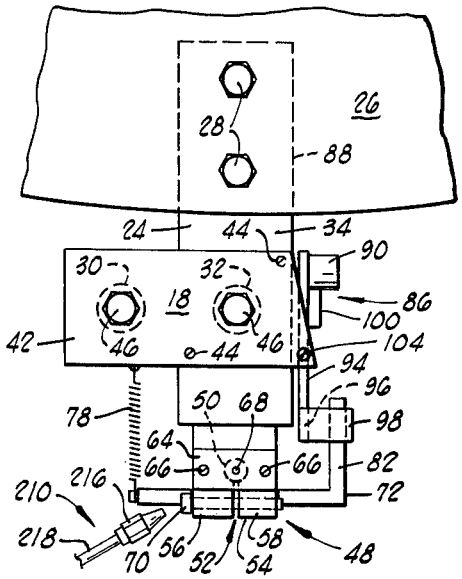
FIG. 3 is a partial top elevational view of the operating unit taken along the line 3—3 in FIG. 2.

The operating unit 12 (FIGS. 1 and 2) is comprised primarily of an upper block 18, a middle block 20 and a lower block 22. The upper block 18 is attached by a horizontally extending portion 24 to a first rigid frame member 26 by a pair of bolts 28. The upper block 18 has a pair of spaced apart, parallel holes 30 and 32 extending generally vertically between the upper surface 34 and the lower surface 36 thereof. A pair of rods 38 and 40 are positioned in the holes 30 and 32, respectively, and project substantially vertically downward therefrom. A back up plate 42 is positioned across the upper ends of the holes 30 and 32, and attached to the upper surface 34 of the upper block 18 by a pair of screws 44 (FIG. 3). The upper ends of the rods 38 and 40 are held in engagement with the bottom surface of the plate 42 by a pair of bolts 46 which pass through the plate 42 into threaded engagement with the upper ends of the rods 38 and 40.

The upper block 18 has a clamp portion 48 integral therewith and extending generally horizontally outward from the vertical plane defined by the longitudinal axes of the parallel rods 38 and 40. The clamp portion 48 has a cylindrical bore 50 extending vertically therethrough. A slot 52 (FIG. 3), also extending vertically through the clamp portion 48, communicates between the bore 50 and the end 54 of the clamp portion 48, thereby defining the two arms 56 and 58 of the clamp portion 48.

An upper die pin 60 is positioned in the bore 50. The upper die pin 60 has a longitudinal bore 62 therethrough, the longitudinal axis of which is coextensive with the longitudinal axis of the upper die pin 60. A back up plate 64 is positioned across the upper end of the bore 50 and is attached to the upper surface 34 of the upper block 18 by a pair of screws 66 (FIG. 3). The plate 64 has a hole 68 therethrough vertically aligned with the bore 62 in the upper die pin 60. The hole 68 is smaller in diameter than the bore 50 but at least as large as the bore 62. Thus, when the upper die pin 60 is clamped in the bore 50 by a bolt 70 extending horizontally through the arm 56 into threaded engagement with the arm 58, the upward movement of the upper die pin 60 is limited by the shoulder defined by the plate 64.

The clamp portion 48 has a substantially C-shaped bracket 72 pivotally attached between the arms 56 and 58 with the mouth of the "C" spanning the width of the clamp portion 48. The lower horizontally extending portion 74 (FIG. 2) of the bracket 72 has an extension 76 which is positioned so as to intersect the downward vertical projection of the bore 50 as the bracket 72 is pivoted toward the rods 38 and 40. The bracket 72 is sized and positioned so as to be freely pivotable below the clamp portion 48 toward the rods 38 and 40, even when the upper die pin 60 is clamped in the clamp portion 48. A coil spring 78, connected between the bottom of the leg 80 of the bracket 72 and the upper block 18, biases the bracket 72 toward the rods 38 and 40. The bracket 72 has an arm 82 (FIG. 3) extending perpendicularly from the upper end of the leg 84 thereof toward the plane defined by the axes of the rods 38 and 40 when the leg 84 is parallel to the rods 38 and 40.

The upper block 18 has a generally L-shaped lever arm assembly 86 (FIG. 6) pivotally attached to the side 88 thereof by a roller bearing 90 mounted on a shaft 92. One arm 94 of the assembly 86 extends generally horizontally from the shaft 92 toward the clamp portion 48. The end 96 of the arm 94 has a extension 98 positioned so that the bottom surface thereof will engage the upper surface of the arm 82 when the arm 94 is pivoted downward. The other arm 100 of the assembly 86 extends generally vertically downward from the shaft 92 and the distal end 102 thereof is angle-cut for reasons which will be made more apparent below. As can be seen most clearly in FIG. 3, the plate 42 has a portion extending horizontally outward from the side 88 of the upper block 18 and a set screw 104 extending vertically downward therethrough to limit the upward pivotal movement of the arm 94 of the lever arm assembly 86.

The middle block 20 (FIGS. 1 and 2) is slidably positioned on the rods 38 and 40 via a pair of spaced apart, parallel holes 106 and 108 of substantially the same diameter as, and axially aligned with, the holes 30 and 32, respectively, in the upper block 18. The middle block 20 has a hollow cylindrical portion 110 extending horizontally outward from the side 112 thereof, the longitudinal axis of which lies in the plane defined by the axes of the rods 38 and 40. A frictional engaging element (not shown) is disposed inside the hollow cylindrical portion 110 and is urged into frictional engagement with the rod 38 by a knurled bolt 114.

Figure 4:
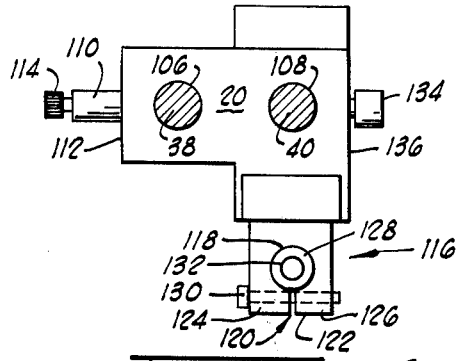
FIG. 4 is a partial cross sectional view of the operating unit taken along the line 4—4 in FIG. 2.

The middle block 20 has a clamp portion 116 integral therewith and extending generally horizontally outward from the plane defined by the axis of the rods 38 and 40, which is substantially vertically aligned with the clamp portion 48 of the upper block 18. The clamp portion 116 has a cylindrical bore 118 extending vertically therethrough, the longitudinal axis of which is vertically aligned with the longitudinal axis of the bore 50 of the clamp 48 in the upper block 18. A slot 120 (FIG. 4), also extending vertically through the clamp portion 116, communicates between the bore 118 and the end 122 of the clamp portion 116; thereby defining the two arms 124 and 126 of the clamp portion 116.

A cylindrical die 128 is clamped in the bore 118 by a bolt 130 extending horizontally through the arm 124 into threaded engagement with the arm 126. The die 128 has a longitudinal bore 132 extending therethrough, the longitudinal axis of which is vertically aligned with the longitudinal axis of the upper die pin 60. The diameter of the bore 132 is slightly larger than the diameter of the upper die pin 60 so that the upper die pin 60 may enter the bore 132 as the middle block 20 is slid upwardly along the rods 38 and 40 toward the upper block 18 as will be set forth below.

The middle block 20 has a roller bearing cam follower 134 attached to the side 136 thereof, the axis of rotation of which is horizontal and at least parallel to the plane defined by the axis of the rods 38 and 40. The follower 134 is positioned so as to engage the angle cut end 102 of the arm 100 of the lever arm assembly 86 as the middle block 20 is slid upwardly along the rods 38 and 40 toward the upper block 18.

The lower block 22 is slidably positioned on the rods 38 and 40 via a pair of spaced apart, parallel holes 138 and 140 of substantially the same diameter as, and axially aligned with, the holes 30 and 32, respectively, in the upper block 18. The lower block 22 has a hollow cylindrical portion 142 extending horizontally outward from the side 144 thereof, the longitudinal axis of which lies in the plane defined by the axis of rods 38 and 40. A frictional engaging element (not shown) is disposed inside the hollow cylindrical portion 142 and is urged into frictional engagement with the rod 38 by a knurled bolt 146.

The lower block 22 has a clamp portion 148 integral therewith and extending generally horizontally outward from the plane defined by the axes of the rods 38 and 40, which is substantially vertically aligned with the clamp portion 48 of the upper block 18. The clamp portion 148 has a cylindrical bore 150 extending vertically therethrough, the longitudinal axis of which is vertically aligned with the longitudinal axis of the bore 50 of the clamp 48 in the upper block 18. A slot 152 (FIG. 5), also extending vertically through the clamp portion 148, communicates between the bore 150 and the end 154 of the clamp portion 148, thereby defining the two arms 156 and 158 of the clamp portion 148.

Figure 5:
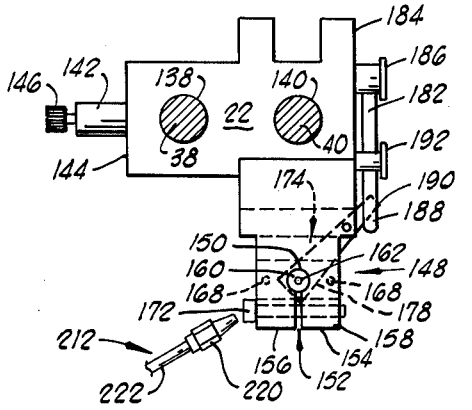
FIG. 5 is a partial cross sectional view of the operating unit taken along the line 5—5 in FIG. 2.

A lower die pin 160 is positioned in the bore 150. The lower die pin 160 has a longitudinal bore 162 extending therethrough, the longitudinal axis of which is vertically aligned with the longitudinal axis of the upper die pin 60. A back up plate 164 is positioned across the lower end of bore 150 and is attached to the lower surface 166 of the lower block 22 by a pair of screws 168 (FIG. 5). The plate 164 has a hole 170 therethrough vertically aligned with the bore 162 in the lower die pin 160. The hole 170 is smaller in diameter than the bore 150 but at least as large as the bore 162. Thus, when the lower die pin 160 is clamped in the bore 150 by a bolt 172 extending horizontally through the arm 156 into threaded engagement with the arm 158, the downward movement of the lower die pin 160 is limited by the shoulder defined by the plate 164.

The lower block 22 has a lead stop 174 pivotally attached by a bolt 176 to the bottom surface 166 of the lower block 22. The stop 174 is mounted so that one end 178 thereof may be pivoted from a position so as to cover the hole 170 in the plate 164 (as best shown in FIG. 5), to a position so as to uncover the hole 170. The stop 174 has a downwardly projecting portion 180 which provides a convenient means for manually effecting the pivotal movement of the stop 174.

The lower block 22 has a flat spring 182 (FIG. 5) attached to the side 184 thereof by a mounting shaft 186. The spring 182 is disposed in a substantially horizontal position along the side 184 with the free end 188 extending over the end 190 of the stop 174. A radially flanged shaft 192 is attached to the side 184 of the lower block 22 so as to provide a fulcrum for tensioning the end 188 of the spring 182 in a downward direction to exert a frictional binding force on the stop 174.

The operating unit 12 is completed by a bracket 194 positioned at the bottom of the rods 38 and 40. The bracket 194 has a U-shaped notch 196 extending vertically through one end 198 thereof sized to receive the bottom end 200 of the rod 38. The bracket 194 has a clamp portion 202 formed in the other end 204 thereof formed in substantially the same manner as the clamp portions 48, 116 and 148. The bottom end 206 of the rod 40 is clamped in the clamp portion 202 by a bolt 208 such that the bracket 194 maintains the rods 38 and 40 in substantially parallel relationship.

The heating unit 14 is comprised of a pair of flame burners 210 and 212, and a mounting bracket assembly 214. The flame burner 210 has a burner head 216 mounted on a substantially rigid fuel supply line 218. The flame burner 212 has a burner head 220 mounted on a substantially rigid fuel supply line 222.

The mounting bracket assembly 214 has an L-shaped brace 224 which is attached to a second rigid support member 226 by a pair of bolts 228. A pair of clamps 230 and 232 formed in substantially the same manner as the clamp portions 48, 116, 148 and 202 are attached to the horizontal leg 234 of the brace 224 near the knee 236 of the brace 224 by a bolt 238. The line 218 is clamped in the clamp 230 by a screw 240. The line 222 is clamped in the clamp 232 by a screw 242. The lines 218 and 222 are attached to a fuel supply (not shown) in a conventional manner.

The compression unit 16, shown in FIG. 6, is comprised primarily of a power assembly 244, a power transfer assembly 246 and a fluid pressure compensator 248. The power assembly 244 has a lever arm 250 pivotally attached at one end 252 to a third rigid support member 254 via a bolt 256. The middle portion 258 of the lever arm 250 is slidably positioned against the peripheral edges 260 of a cam 262. The cam is mounted on a rotatable shaft 264 and is rotatable thereby. A power source (not shown) is attached to the shaft 264 in a conventional manner to rotate the shaft 264 thereby reciprocating the other end 266 of the lever arm 250.

The power transfer assembly 246 is comprised of a push rod 268, a clevis 270 and a connecting rod 272. The push rod 268 is connected to the clevis 270 at one end 274 thereof. The clevis 270 is pivotally connected to the connecting rod 272 by a pin 276. The connecting rod 272, which is slidably disposed through the guide hole 278 in a fourth rigid support member 280, is sized and positioned vertically so as to engage the bottom surface 282 of the lower block 22 when the compression unit 16 and the operating unit 12 are adjacent as shown in FIG. 6.

The fluid pressure compensator 248 is comprised of a cylinder 284, a piston 286, a pressure reservoir 288 and a regulated pressure supply 290. The cylinder 284 is pivotally connected to the end 266 of the lever arm 250 via a tab 292 and a pin 294. The piston 286, which is connected to the lower end 296 of the push rod 268, is slidably disposed within the cylinder 284. The piston 286 is maintained in sealing engagement with the inner walls of the cylinder 284 in a conventional manner, so as to define a chamber 298 within the cylinder 284.

The pressure reservoir 288 is connected to the chamber 298 by a pressure line 300. The pressure reservoir 288 and the chamber 298 are preferably filled with a pressurizable fluid such as air, the fluid being flowable between the pressure reservoir 288 and the chamber 298 via the pressure line 300. The regulated pressure supply 290, which is connected to the pressure reservoir 288 by a pressure line 302, maintains the pressure in the pressure reservoir 288 and the chamber 298 above a predetermined minimum, for the purposes to be described.

OPERATION OF THE PREFERRED EMBODIMENT

In operation, a series of operations are performed upon the operating unit 12 in order to produce a resistor. To this end, the operating unit 12 may be moved past a series of functional units, such as the heating unit 14 or the compression unit 16, where one or more of the individual operations described herein are performed. Alternatively, the operating unit 12 may remain fixed and the functional units be moved therepast.

From the dimensions of the desired resistor, the diameter of the die pins 60 and 160, and the bores 62, 132 and 162 can be determined using conventional tolerances. The length of the die pins 60 and 160, and the connecting rod 290 can be established in a manner which will become apparent as this discussion proceeds. The quantity of the resistive material to be used in forming each resistor can be determined in a conventional manner.

From the dimensional specifications, a pair of leads 304 and 306 are cut either by hand or machine to the desired length from a supply, such as a spool of copper wire. The lead 304 is then inserted, either from above or below, into the bore 62 in the upper die pin 60. As the lead 304 is inserted into the upper die pin 60, the bracket 72 is positioned so as to frictionally bear against the lead 304 near the lower end 308 thereof but leaving the end 308 itself exposed. The lead 306 is then inserted, either from above or below, into the bore 162 in the lower die pin 160. As the lead 306 is inserted into the lower die pin 160, the lead stop 174 is positioned so as to support the lower end of the lead 306. It is clear, therefor, that the length of the lower die pin 160 should be established so as to leave the upper end 310 of the lead 306 exposed, and that the length of the upper die pin 60 should be established so as to allow the bracket 72 to bear effectively against the lead 304.

After the leads 304 and 306 are properly positioned, essentially as shown in FIGS. 1 and 2, the operating unit 12 and the heating unit 14 are positioned adjacent each other so that the burners 216 and 220 are directed at the exposed ends 308 and 310 of the leads 304 and 306, respectively. The burners 216 and 220 are controlled by conventional means both as to intensity, flame shape and duration of exposure so as to melt the ends 308 and 310, to form enlarged, substantially round heads 312 and 314 on the ends 308 and 310 of the leads 304 and 306, respectively. The burners 216 and 220, which would normally burn a conventional natural gas mixture, may alternatively burn hydrogen to perform the additional operation of cleaning the heads 312 and 314 of any undesirable oxides adhearing thereto.

Once the heads 312 and 314 have been formed, the operating unit 12 and the heating unit 14 are separated and the heads 312 and 314 allowed to cool. The middle block 20 and the lower block 22 are then moved together, against the frictional force exerted by the frictional elements in the cylindrical portions 110 and 142, until the lower die pin 160 projects a relatively short distance into the axially aligned bore 132 in the die pin 128. With the lower die pin 160 substantially blocking the bottom of the bore 132, the predetermined quantity of resistive material is inserted into the bore 132.

In the preferred embodiment, the lead stop 174 is then pivoted, against the frictional force exerted by the flat spring 182, so as to allow the lead 306 to drop downward in the bore 162 until the head 314 engages the upper end of the lower die pin 160. The delay in dropping the lead 306 until after the resistive material has been inserted in the die 128, is desirable in order to assure that substantially the entire outer surface of the head 314 is in contact with the resistive material. Of course, if desired, the lead 306 may be dropped before the resistive material is inserted into the die 128, or the lead 306 may be pulled downward a predetermined distance to assure that the head 314 occupies a particular position in the resistive material.

The middle block 20 and the lower block 22 are then moved upward together, along the rods 38 and 40 toward the upper block 18. When the head 312 of the lead 304 enters the axially aligned bore 132 in the die 128, the angle cut end 102 of the arm 100 of the lever arm assembly 86 engages the roller bearing cam follower 134. Further upward movement of the middle block 20 causes the lever arm assembly 86 to pivot counter-clockwise as viewed in FIG. 6. The pivotal movement of the lever arm assembly 86 is communicated to the bracket 72 via the extension 98 of the arm 94 and the arm 82 of the bracket 72, so that the bracket 72 is pivoted out of the path of the middle block 20. The movement of the bracket 72 also allows the lead 304 to slide in the bore 62 so that the head 312 is moved into the resistive material in the bore 132 as the die 128 is moved upward around the upper die pin 60.

When the middle block 20 and the lower block 22 have been positioned so that the upper die pin 60 extends a relatively short distance into the bore 132, the operating unit 12 and the compression unit 16 are positioned adjacent each other so that the upper end 316 of the connecting rod 272 is below and vertically aligned with the lower block 22, substantially as shown in FIG. 6. Power is then applied to the shaft 264 to rotate the cam 262. The rotation of the cam 262 pivots the lever arm 250 and moves the cylinder 284 upward in a conventional manner. The rotary power supplied to the shaft 264 is thus converted by the power assembly 244 into a straightline compressional force produced over a fixed distance, the distance being related to the dimensions of the cam 262 and the lever arm 250 in a manner well understood in the art.

The force applied to the cylinder 284 is coupled to the power transfer assembly 246 by the fluid pressure compensator 248. Any force so coupled is transferred by the power transfer assembly 246 to the resistive material in the die 128 via the lower block 22 and the upper and lower die pins 60 and 160, respectively. If the pressure applied to the resistive material is above a minimum, on the order of 30,000 psi, then the resistive material will be forced into intimate electrical and mechanical contact with the heads 312 and 314 to form an integral resistive body which is curable using conventional heat treatment to obtain a stable resistor. However, since the electrical resistance of the resistive body is more dependent upon the pressure applied than upon the final length, the force produced by the power assembly 244 is transferred to the resistive material as a predetermined pressure applied over a variable distance via the fluid pressure compensator 248.

The dimensions of the power assembly 244 can be established in a conventional manner by determining the total distance that the lower die pin 160 must be moved upward from the initial compression starting point until the resistive material has been compressed to the desired length. Once the upwardmost limit of travel of the cylinder 284 has been established, the working point of the piston 286 should be established so that the piston 286 is free to move both upward and downward in the cylinder 284 in order to compensate for small variations in the length of the resistive body due to differences in the compressability of the resistive material. The dimensions of the power transfer assembly 246 can then be established by determining the total distance between the initial compression starting position of the lower block 22 and the working point of the piston 286 when the cylinder 284 is positioned at the upwardmost limit of travel.

It is clear that the pressure in the fluid pressure compensator 248 will be less when the compression unit 16 is in the non-compression position shown in FIG. 6, than when the compression unit 16 is in the full compression position, due to the change in the volume of the chamber 298 when the piston 286 is moved from the rest position against the end wall 318 of the cylinder 284 to the working point. Further, it is clear that the change in pressure between the non-compression and compression positions is dependent upon the volume of the reservoir 288 as compared to the volume of the chamber 298. In other words, the pressure in the chamber 298 when the compression unit 16 is in the compressed position is dependent not only upon the static pressure maintained in the chamber 298 when the piston 286 is in the non-compressed position, but also upon the ratio of the volume of the chamber 298 to the volume of the reservoir 288.

In determining the size of the reservoir 288, the primary consideration is to assure that the pressure in the chamber 298 when the piston 286 is in the compressed position will not vary beyond an acceptably pressure tolerance as the length of the resistive body varies within an established length tolerance. In the preferred embodiment, a reservoir 288 volume on the order of 20 times as large as the volume of the chamber 298 has been found to be satisfactory.

The static pressure to be maintained in the reservoir 288, and thus the chamber 298, when the compression unit 16 is in the non-compressed position can be computed in a conventional manner using the above described volume specifications and the pressure at which the resistive body is to be formed. Alternatively, the pressure may be determined substantially automatically by regulating the supply 290 so that the pressure in the reservoir 288 will not exceed the desired final compression pressure when the compression unit 16 is in the compressed position.

Although the burner unit 14 has been described herein as a flame burner, other types of heating apparatus, such as induction heaters, would be equally effective in melting the ends 308 and 310 of the leads 304 and 306 to form the enlarged, substantially ball shaped heads 312 and 314 thereon.

As will be clear to those skilled in the art from a review of the above description, the apparatus 10 of the present invention will produce resistors in an efficient and economical manner. The apparatus 10 is highly predictable in the characteristics of the resistors produced thereby, since the apparatus is designed to assure that the resistive material is compressed under a predetermined pressure. Thus, once the various dimensions of the apparatus 10 have been established, the resistance of the resistors subsequently produced will be substantially predeterminable, at least within the operational limitations imposed by the apparatus feeding the resistive material into the die 128.

Other changes may be made in the construction and the arrangement of the parts or the elements of the various embodiments as disclosed herein without departing from the spirit and scope of the invention as defined in the following claims.

What is claimed is:

1. An apparatus for producing a resistor from a lead and a quantity of resistive material, comprising:

heating means for melting one end of the lead to form an enlarged, substantially round head on the end of the lead;

die means for retaining the resistive material;

means for positioning the head on the end of the lead in the resistive material in the die means; and, fluid pressure compensated compression means for applying a predetermined pressure to the resistive material in the die means to form an integral resistive body around the head, the resistive body being curable to obtain a resistor, the fluid pressure compensated compression means comprising:

power means for producing a compressional force over a fixed distance;

power transfer means for applying a compressional force coupled thereto to the resistive material in the die; and, fluid pressure compensation means for coupling the compressional force produced by the power means to the power transfer means while limiting the compressional force to a predetermined pressure.

2. The apparatus of claim 1 wherein the heating means is a flame burner.

3. The apparatus of claim 2 wherein the flame burner burns hydrogen.

4. The apparatus of claim 1 wherein the means for positioning is a die pin having a bore therein sized to receive the lead.

5. An apparatus for producing a resistor from a lead and a quantity of resistive material, comprising:

an operating unit comprising:

an upper die pin having a bore therein sized to receive the lead;

a die having a bore therein sized to receive the upper die pin, for retaining the resistive material;

means cooperating with the upper die pin, for leaving exposed one end of the lead in the upper die pin; and means for moving the upper die pin into the bore in the die thereby positioning the exposed end of the lead in the resistive material, said means comprising:

an upper block having a clamp portion, the upper die pin being clamped in the clamp portion of the upper block;

a rod connected to the upper block and projecting substantially vertically downward therefrom; and a middle block having a clamp portion, the middle block being slidably positioned on the rod so that the clamp portion of the middle block is substantially vertically aligned with the clamp portion of the upper block, the die being clamped in the clamp portion of the middle block so that the longitudinal axis of the bore in the die is vertically aligned with the longitudinal axis of the upper die pin;

a heating unit positionable adjacent the operating unit, for melting the exposed end of the lead to form an enlarged, substantially round head thereon; and a fluid pressure compensated compression unit positionable adjacent the operating unit, for applying a predetermined pressure to the resistive material in the die via the upper die pin, to form an integral resistive body around the head, the resistive body being curable to obtain a resistor.

6. The apparatus of claim 5 wherein the heating unit is a flame burner.

7. The apparatus of claim 6 wherein the flame burner burns hydrogen.

8. The apparatus of claim 5 wherein the means cooperating with the upper die pin is a substantially C-shaped bracket pivotally attached to the upper block so as to span the clamp portion, the bracket being sized so as to be freely pivotable below the clamp portion and the upper die pin clamped therein, and spring biased toward the rod so as to frictionally bear against the lead inserted in the bore in the upper die pin leaving one end of the lead exposed.

9. The apparatus of claim 5 wherein the bore in the die extends therethrough; wherein the operating unit is further defined to include:

a lower die pin having a bore therein sized to receive a second lead, the lower die pin being substantially the same size as the upper die pin; and, means cooperating with the lower die pin for leaving exposed one end of the second lead in the lower die pin;

wherein the means for moving the upper die pin into the bore in the die includes a lower block having a clamp portion, the lower block being slidably positioned on the rod so that the clamp portion of the lower block is substantially vertically aligned with the clamp portion of the upper block; wherein the lower die pin is clamped in the clamp portion of the lower block so that the longitudinal axis of the lower die pin is vertically aligned with the longitudinal axis of the upper die pin; and wherein the heating unit also melts the exposed end of the second lead to form an enlarged, substantially round head thereon.

10. The apparatus of claim 9 wherein the means cooperating with the lower die pin is a lead stop pivotally attached to the bottom of the lower block so as to be pivotal from a position covering the bore in the lower die pin to a position uncovering the bore in the lower die pin.

11. The apparatus of claim 9 wherein the fluid pressure compensated compression unit is further defined as comprising:

power means for producing a compressional force over a fixed distance;

power transfer means for applying a compressional force coupled thereto to the resistive material in the die via the upper and lower die pins; and fluid pressure compensation means for coupling the compressional force produced by the power means to the power transfer means while limiting the compressional force to a predetermined pressure.

12. The apparatus of claim 11 wherein the fluid pressure compensation means is further defined as comprising:

a cylinder connected to the power means;

a piston disposed in the cylinder in sealing engagement therewith and connected to the power transfer means, the piston defining a chamber within the cylinder;

a pressure reservoir connected to the chamber;

a pressurizable fluid disposed in the pressure reservoir and the chamber and flowable therebetween; and, a regulated pressure supply connected to the pressure reservoir.

* * * * *